US006446288B1

(12) United States Patent
Pi

(10) Patent No.: US 6,446,288 B1
(45) Date of Patent: Sep. 10, 2002

(54) MEDICAL SUPPORT PILLOW FOR FACILITATING ENDOTRACHAEL INTUBATION

(76) Inventor: Kaiduan Pi, 122 Edwards St., 3rd Floor, New Haven, CT (US) 06511

( * ) Notice: Subject to any disclaimer, the term of this patent is extended or adjusted under 35 U.S.C. 154(b) by 0 days.

(21) Appl. No.: 09/550,627

(22) Filed: Apr. 17, 2000

Related U.S. Application Data

(60) Provisional application No. 60/135,779, filed on May 24, 1999.

(51) Int. Cl.[7] ..... A47G 9/00

(52) U.S. Cl. ..... 5/636; 5/637; 5/640

(58) Field of Search ..... 5/636, 637, 638, 5/639, 640, 643, 645, 622, 631, 632, 655, 735

(56) References Cited

U.S. PATENT DOCUMENTS

| | | | | | |
|---|---|---|---|---|---|
| 2,940,087 | A | * | 6/1960 | Kiefer | 5/642 |
| 3,118,152 | A | * | 1/1964 | Talley, Jr. | 5/636 X |
| 3,139,631 | A | * | 7/1964 | Kiefer | 5/643 |
| 3,378,862 | A | * | 4/1968 | Skinner | 5/735 X |
| 3,694,831 | A | * | 10/1972 | Treace | 5/636 X |
| 4,259,757 | A | * | 4/1981 | Watson | 5/637 |
| 4,320,543 | A | | 3/1982 | Dixon | 5/434 |
| 4,494,261 | A | | 1/1985 | Morrow | 5/436 |
| 4,748,702 | A | * | 6/1988 | Sandler | 5/636 |
| 4,768,246 | A | | 9/1988 | Summer | 5/434 |
| 4,773,107 | A | | 9/1988 | Josefek | 5/434 |
| 4,790,041 | A | * | 12/1988 | Shtull | 5/655 X |
| 4,803,743 | A | | 2/1989 | Greenawalt | 5/434 |
| 4,829,614 | A | | 5/1989 | Harper | 5/436 |
| 4,850,068 | A | * | 7/1989 | Walpin et al. | 5/636 |
| 4,918,774 | A | | 4/1990 | Popitz | 5/441 |
| 4,964,418 | A | * | 10/1990 | Wilson | 5/636 X |
| 5,025,518 | A | * | 6/1991 | Summer | 5/636 |
| 5,035,015 | A | * | 7/1991 | Maietta | 5/630 |
| 5,146,641 | A | * | 9/1992 | Zwickey | 5/637 X |
| 5,153,960 | A | * | 10/1992 | Ritter et al. | 5/637 X |
| 5,163,194 | A | | 11/1992 | Dixon | 5/636 |
| 5,177,823 | A | | 1/1993 | Riach | 5/636 |
| 5,193,238 | A | * | 3/1993 | Clute | 5/655 |
| 5,216,772 | A | * | 6/1993 | Clute | 5/638 X |
| 5,269,035 | A | | 12/1993 | Hartunian | 5/638 |
| 5,357,642 | A | * | 10/1994 | Clute | 5/632 X |
| 5,369,824 | A | * | 12/1994 | Powell | 5/735 |

(List continued on next page.)

FOREIGN PATENT DOCUMENTS

| | | | | |
|---|---|---|---|---|
| DE | 2009792 | * | 11/1970 | 5/636 |

*Primary Examiner*—Robert G. Santos

(57) ABSTRACT

A medical support pillow for facilitating endotrachael intubation comprising a base member having a pair of oppositely positioned sidewalls, a bottom portion having a bottom surface, and an upper portion. The upper portion has a first inclined surface for receiving a portion of the upper back of a patient and a recess for receiving the occipital area of the patient's head. The recess is adjacent to the inclined surface and extends in a direction that is generally perpendicular to the sidewalls. The upper portion further includes a second inclined surface that is adjacent to the recess wherein the recess is intermediate the first and second inclined surfaces. In one embodiment, the medical support pillow comprises a pad member configured to be removably positioned within the recess. The pad member comprises a top portion for receiving the patient's head. The pad member may be positioned within the recess after intubation has been completed. In a further embodiment, the pad portion further comprises a cavity having an opening accessible through the top portion of the pad member. In such an embodiment, the medical support pillow further includes a hemispherical member removably positioned within the cavity. The hemispherical member may be removed to allow the occiput of patient's head to sink into the cavity to substantially eliminate pressure on the occipital area of patient's head and to prevent any substantial movement of the patient's head while extended.

12 Claims, 7 Drawing Sheets

U.S. PATENT DOCUMENTS 5,457,832 A 10/1995 Tatum ..... 5/636
5,469,592 A * 11/1995 Johnson ..... 5/655.3 X
5,471,691 A * 12/1995 Ryndak ..... 5/636 X
5,519,907 A * 5/1996 Poths ..... 5/636
5,528,784 A 6/1996 Painter ..... 5/640
5,615,432 A 4/1997 Von Ohlen, III ..... 5/638
5,638,564 A * 6/1997 Greenawalt et al. ..... 5/636
5,720,061 A * 2/1998 Giori et al. ..... 5/735
D392,145 S * 3/1998 Thurston ..... D6/604
5,768,725 A 6/1998 Brenn ..... 5/636
5,797,154 A 8/1998 Contreras ..... 5/636
D403,194 S * 12/1998 Thurston ..... D6/604
6,158,813 A * 12/2000 Karash ..... 297/391
6,176,549 B1 * 1/2001 Karash ..... 297/391

* cited by examiner

MEDICAL SUPPORT PILLOW FOR FACILITATING ENDOTRACHAEL INTUBATION

This application claims the benefit of commonly owned and copending U.S. Provisional Application Serial No. 60/135,779, filed May 24, 1999.

BACKGROUND OF THE INVENTION

1. Field of the Invention

The present invention generally relates to a medical support pillow for facilitating endotracheal intubation.

2. Problem to be Solved

In order to perform endotracheal intubation on a patient, it is preferred that the patient's head be positioned in what is known as the "sniff" position such that the oral, pharyngeal and laryngeal axes are substantially aligned with one another. Typically, a pad known as a "doughnut" is used to position and maintain the patient's head in the sniff position. However, the doughnut can only elevate the patient's head and cannot maintain the patient's head in the sniff position. Other techniques for maintaining the patient's head in the sniff position entail holding the patient's head or the use of blankets to position the patient's head in an extended position. However, these techniques are not reliable and are time inefficient. The inability to achieve and/or maintain the sniff position may result in intubation failure. What is needed is a device that will enable safe, quick, and accurate alignment of the oral, pharyngeal and laryngeal axes to facilitate proper endotracheal intubation.

Therefore, it is an object of the present invention to provide a medical support pillow that maintains a patient's head in the proper position so as to enable successful endotracheal intubation.

Other objects and advantages of the present invention will be apparent to one of ordinary skill in the art in light of the ensuing description of the present invention.

SUMMARY OF THE INVENTION

The medical support pillow of the present invention facilitates positioning the patient's head and neck in the sniff position thereby facilitating mask ventilation, endotracheal intubation, fibroptic intubation and insertion of a laryngeal mask ("LMA").

In one aspect, the present invention is directed to a medical support pillow that comprises a base member having a pair of oppositely positioned sidewalls, a bottom portion and an upper portion. The bottom portion has a bottom surface. The upper portion comprises an inclined surface for supporting a portion of a patient's upper back. The inclined surface extends from a lower end to an upper end. The upper portion further includes a generally concave-shaped recess for receiving the occipital area of the patient's head. The recess is adjacent to the inclined surface and extends in a direction that is generally perpendicular to the sidewalls of the base member. The base member further includes an end portion that is adjacent to the recess wherein the recess is between the inclined surface and the end portion. The end portion is angulated with respect to the bottom portion.

In one embodiment, the medical support pillow further comprises a pad portion removably positioned within the recess. The pad portion comprises a (i) pair of oppositely positioned sidewalls, (ii) a generally concave-shaped bottom portion that conforms to the generally concave-shaped recess and which longitudinally extends between the sidewalls, (iii) a first generally planar portion that is attached to the sidewalls and the generally concave-shaped bottom portion, and (iv) a second generally planar portion positioned between and attached to the first generally planar portion and the generally concave-shaped bottom portion. The second generally planar portion is angulated with respect to the first generally planar portion.

In another embodiment, the pad portion further comprises a cavity having an opening accessible through the first generally planar portion. In such an embodiment, the medical support pillow further comprises a hemispherical member removably disposed within the cavity. The hemispherical member comprises a body portion which has a generally planar top portion. The body portion is sized for disposal within the cavity of the pad portion. The generally planar top portion is generally coplanar with the first generally planar portion of the pad portion when the hemispherical member is disposed within the cavity.

BRIEF DESCRIPTION OF THE DRAWINGS

The features of the invention are believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE PREFERRED EMBODIMENT

In describing the preferred embodiments of the present invention, reference will be made herein to FIGS. 1–12 of the drawings in which like numerals refer to like features of the invention.

Figure 1:
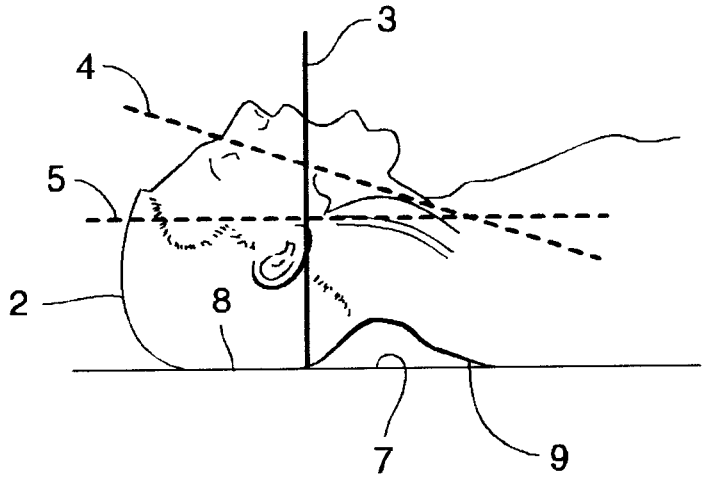
FIGS. 1–3 are diagrams illustrating the required head position for endotracheal intubation.
Figure 2:
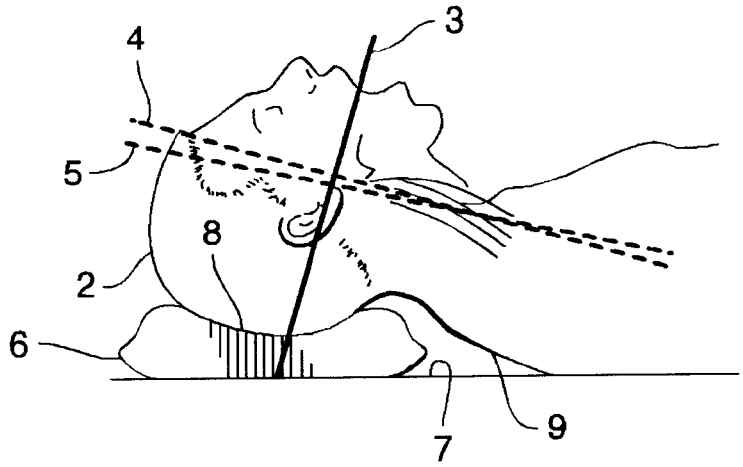
Figure 3:
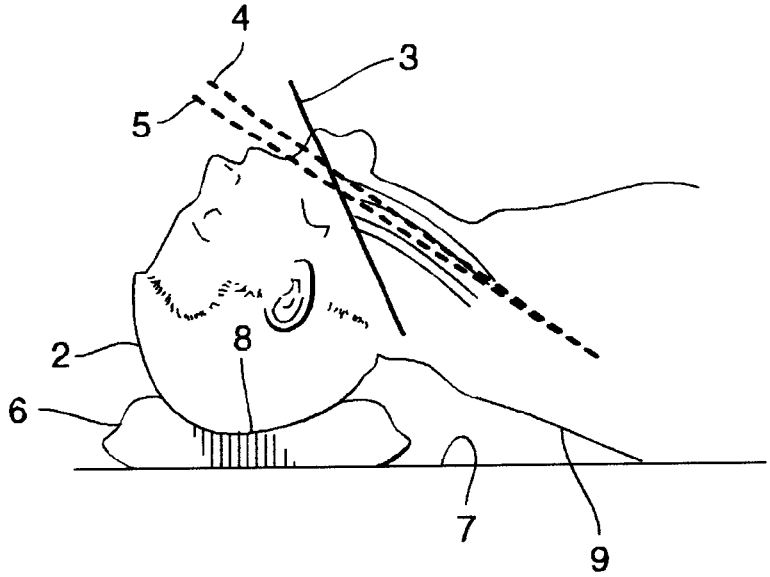

In order to facilitate understanding of the present invention, the ensuing description is preceded by a discussion on the required position of a patient's head to enable endotracheal intubation and the inefficiency of conventional pads or "doughnuts". Referring to FIGS. 1–3, there are shown diagrams that illustrate the proper steps for aligning the patient's head 2 to achieve proper head alignment for endotracheal intubation. The airway between the oral orifice and rima glottides is not in the form of one straight line. In order to achieve successful direct laryngoscopy, oral, pharyngeal and laryngeal axes 3, 4 and 5, respectively (see FIG. 1) must be aligned. Such alignment provides the most optimal visualization of laryngeal inlet. As shown in FIG. 2, conventional pad 6 is placed on table 7 so as to elevate occiput 8 of patient's head 2 while keeping the patient's shoulders 9 on table 7. This step results in the alignment of pharyngeal and laryngeal axes 4 and 5. Next, patient's head 2 is extended at the atlanto-occipital joint so as to provide the shortest distance and most nearly straight line from the incisor teeth to the glottic opening. This is illustrated in FIG. 3. However, extension of patient's head 2 can be very difficult to achieve even with a conscious patient since it difficult for the patient to maintain the "head extension" position. This problem is exacerbated when the patient is in an anesthetized state after intravenous induction because there is a natural tendency for anteflextion of the head. In order to maintain the "head extension" position, the laryngoscopist typically has an assistant hold the patient's head in the extended position, or in the alternative, to place blankets under the patient's head in the sniff position.

As shown in the ensuing description, the medical support pillow of the present invention achieves effects proper alignment of oral, pharyngeal and laryngeal axes 3, 4 and 5, respectively, to enable endotracheal intubation in a quick, precise and safe manner.

Figure 7:
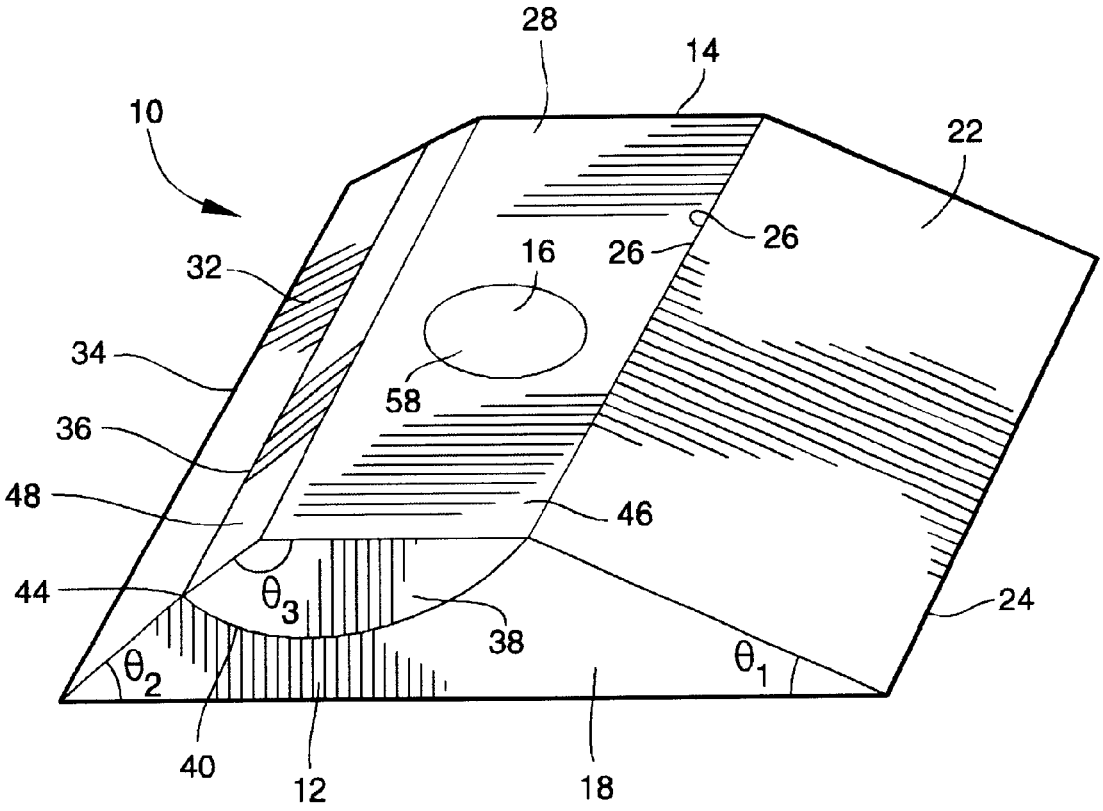
FIG. 7 is a perspective view of the medical support pillow of the present invention.

Referring to FIG. 7, medical support pillow 10 of the present invention general comprises base member 12, pad member 14 and hemispherical member 16. Pad member 14 is removably positioned on base member 12. Hemispherical member 16 is removably attached to pad member 14. In order to facilitate understanding of the present invention, base member 12, pad member 14 and hemispherical member 16 are described separately in the ensuing description.

Figure 4:
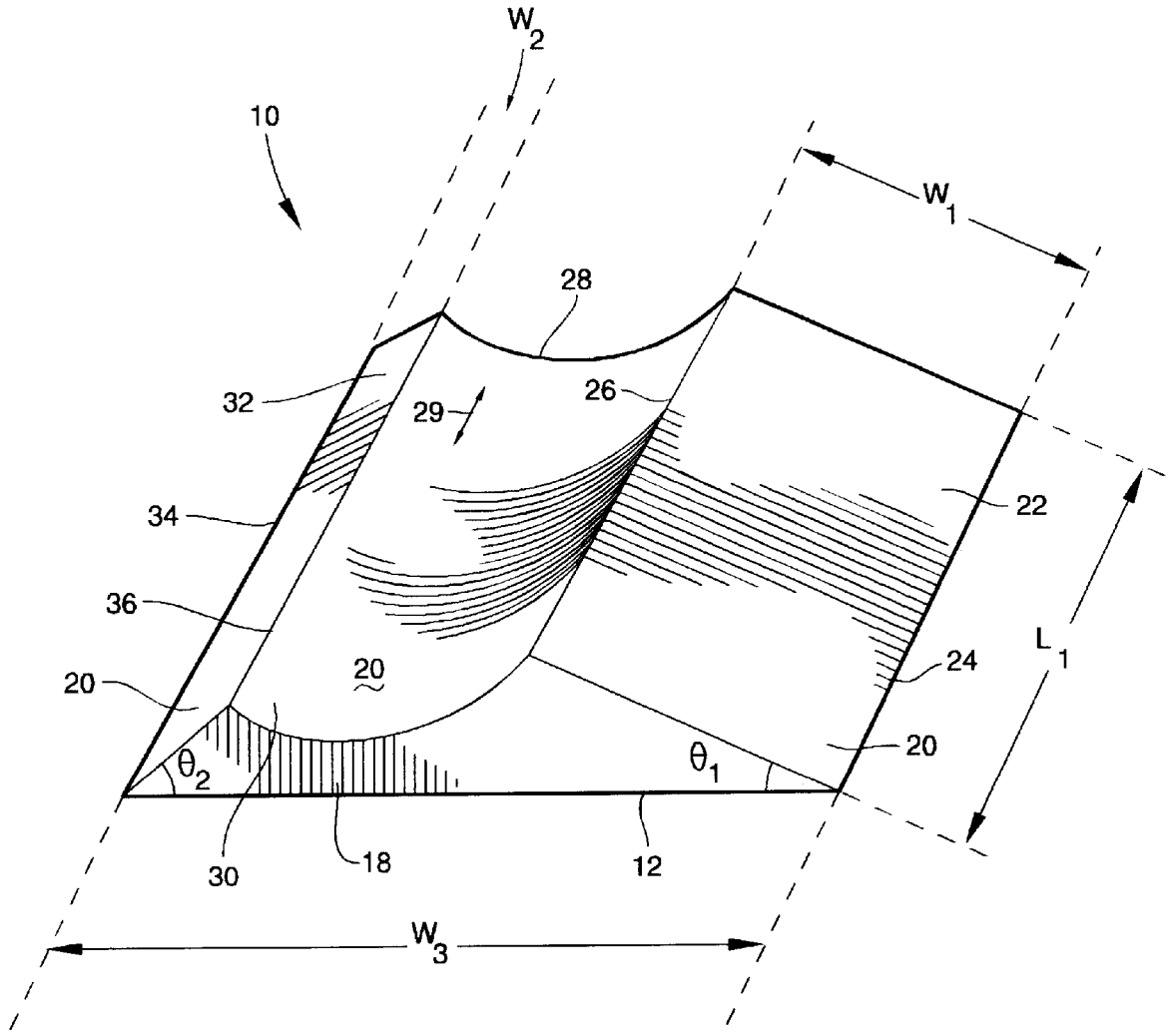
FIG. 4 is a perspective view of a base member of the medical support pillow of the present invention.

Referring to FIG. 4, base member 12 comprises oppositely positioned sidewalls, one of which being sidewall 18, the other sidewall not being shown, bottom portion 19 and upper portion 20 which is attached to the sidewalls. Upper portion 20 comprises inclined surface 22 that extends from lower end 24 to upper end 26. Upper portion 20 further includes generally concave-shaped recess 28 that extends in a direction indicated by axis 29. As shown in FIG. 4, axis 29 extends in a direction that is generally parallel to end 24 of first inclined surface 22. Recess 28 has surface 30 that is contiguous with upper end 26 of first inclined surface 22. Base member 12 further includes second inclined surface 32 that extends from a lower end 34 to an upper end 36. Upper end 36 of second inclined surface 32 is contiguous with surface 30 of recess 28 and generally parallel to the axis 29 of recess 28.

Referring to FIG. 4, inclined surface 22 has a width W1 and second inclined surface 32 has a width W2. In one embodiment, width W1 is substantially greater than width W2. In one embodiment, upper end 26 of first inclined surface 22 is higher than upper end 36 of second inclined surface 32. In a preferred embodiment, the degree of inclination θ1 of first inclined surface 22 is between about 22° and 40°. In one embodiment, the degree of inclination θ1 of first inclined surface 22 is about 23°. In a preferred embodiment, the degree of inclination θ2 of second inclined surface 32 is between about 30° and 50°. In one embodiment, the degree of inclination θ2 of second inclined surface 32 is about 40°. In a preferred embodiment, base member 12 has a length L1 between about 8 and 12 inches. In one embodiment, length L1 is about 11 inches. In a preferred embodiment, base member 12 has a width W3 between about 14 and 20 inches. In one embodiment, width W3 is about 17 inches.

Figure 5:
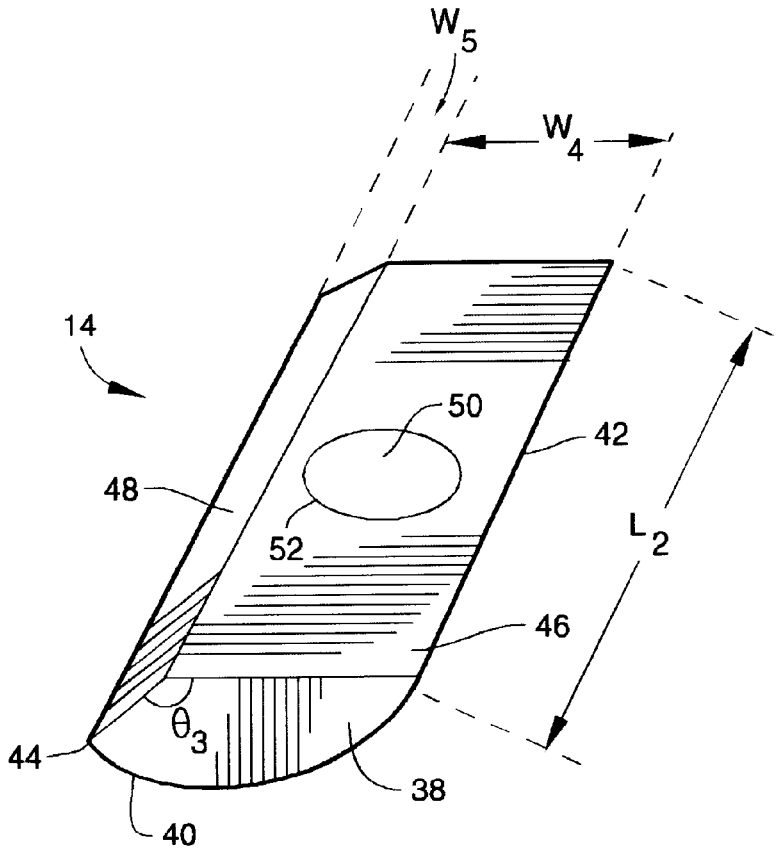
FIG. 5 is a perspective view of a pad portion of the medical support pillow of the present invention which can be removably mounted on the base portion of FIG. 1.

Referring to FIG. 5, pad member 14 comprises oppositely positioned sidewalls, one of which being sidewall 38, the other sidewall not being shown, and generally concave-shaped bottom portion 40 that conforms to concave-shaped recess 28. Generally concave bottom portion 40 extends between the sidewalls of pad portion 14 and has first lengthwise end 42 and second lengthwise end 44. Pad portion 14 further includes first generally planar portion 46 that is contiguous with the sidewalls of pad portion 14 and first lengthwise end 42 of the generally concave-shaped bottom portion 40. Pad portion 14 further includes second generally planar portion 48 positioned between and contiguous with first generally planar portion 46 and second lengthwise end 44 of generally concave-shaped bottom portion 40. Second generally planar portion 48 is angulated with respect to first generally planar portion 46. In a preferred embodiment, the degree of angulation θ3 is between about 120° and 160°. In one embodiment, the degree of angulation θ3 is about 140°. In a preferred embodiment, pad member 14 has a length L2 which is substantially the same as length L1. Pad portion 14 has a width W4 which is between about 4 and 6 inches. In one embodiment, width W4 is about 5 inches. In a preferred embodiment, second generally planar portion 48 has a width W5 which is between 2 and 4 inches. In one embodiment, width W5 is about 3 inches.

Referring to FIG. 5, pad member 14 further includes cavity 50. Cavity 50 has opening 52 which is accessible through first generally planar portion 46. Cavity 50 is sized to receive hemispherical member 16 which is discussed in the ensuing description.

Figure 6:
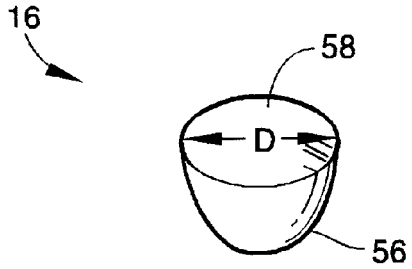
FIG. 6 is a perspective view of a hemispherical member that can be removably disposed in a cavity of the pad portion depicted in FIG. 5.
Figure 6A:
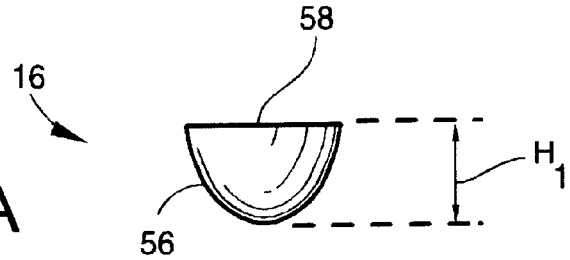
FIG. 6A is a side elevational view of the hemispherical member of FIG. 6.

Referring to FIGS. 6 and 6A, there is shown hemispherical member 16. Hemispherical member 16 generally comprises body portion 56 and generally planar top portion 58. Body portion 56 is sized for disposal within cavity 50 of pad member 14. In a preferred embodiment, generally planar top portion 58 has a diameter D which depends upon the size of opening 52 of cavity 50. In one embodiment, diameter D is about 4.6 inches. In a preferred embodiment, hemispherical member 16 has a height H1 that depends upon the depth of cavity 50 (see FIG. 5). In one embodiment, height H1 is about 2.5 inches. In accordance with the present invention, hemispherical member 16 is removably disposed within cavity 50.

Referring to FIG. 7, in a preferred embodiment, when pad member 14 is disposed within recess 28, first generally planar portion 46 is generally horizontal. In a preferred embodiment, when hemispherical member 16 is disposed within cavity 50, generally planar top portion 58 is generally coplanar with first generally planar portion 46 of pad member 14.

Figure 8:
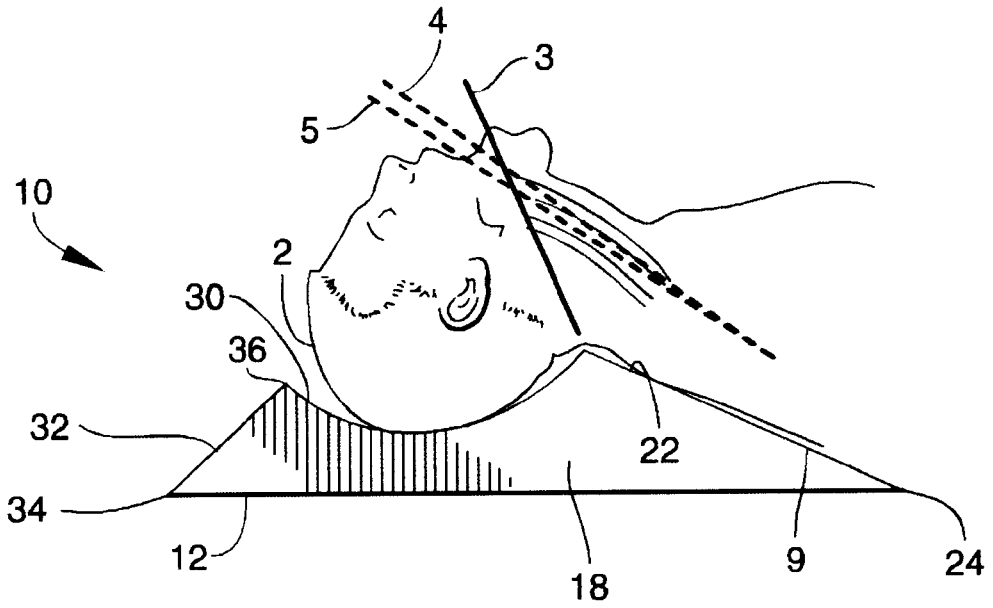
FIG. 8 is a side elevational view showing a patient's head supported by the medical support pillow of the present invention, the medical support pillow being configured to position the patient's head in the sniff position.
Figure 9:
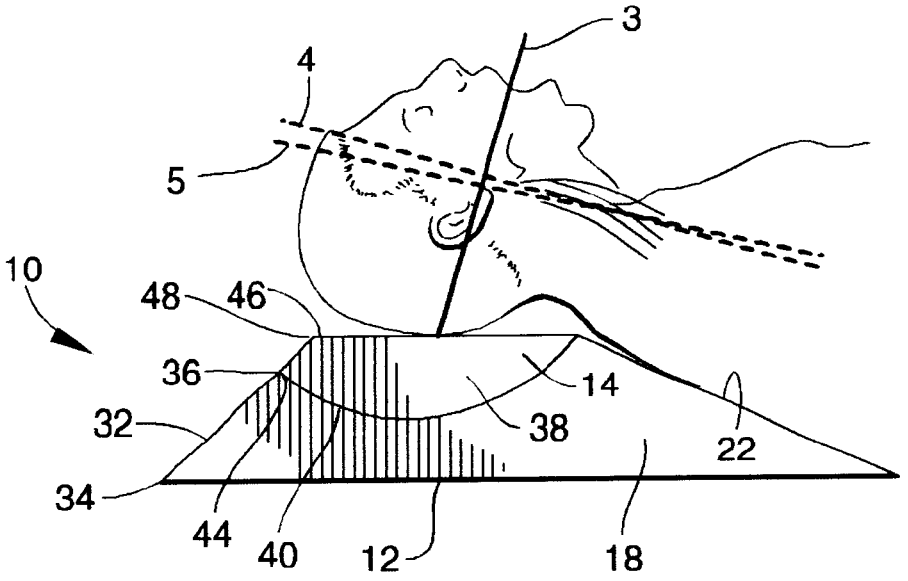
FIG. 9 is a side elevational view of the medical support pillow of the present invention configured to position the patient's head in a natural or normal position.

Referring to FIG. 8, there is shown patient's head 2 supported by medical support pillow 10 of the present invention which is configured to position the patient's head such that the oral, pharyngeal and laryngeal axes 3, 4 and 5 are substantially aligned with one another. Specifically, pad member 14 is removed so as to allow patient's head 2 to drop into recess 28 while inclined surface 22 supports the lower neck and upper back regions of the patient. Proper endotracheal intubation can now be successfully performed on the patient. Referring to FIG. 9, once proper endotracheal intubation has be achieved, pad portion 14 can be inserted into recess 28 so as to position patient's head 2 in a natural or normal position. Hemispherical member 16 may be removed to allow the occiput of patient's head 2 to sink into cavity 58 to substantially eliminate pressure on the occipital area of patient's head 2. Furthermore, the placement of the occipital area in cavity 58 prevents any substantial movement of the patient's head 2 while extended, hemispherical member 16 can be removed so as to allow the occiput of patient's head 2 to sink into cavity 50 (see FIG. 5).

Although the foregoing description has been in terms of medical support pillow 10 being used for purposes of endotracheal intubation, it is to be understood that pillow 10 can be used for other purposes as well. For example, pillow 10 can be used in the performance of cardiopulmonary resuscitation ("CPR"). In order to resuscitate a patient, it is very important to maintain airway patency. In order to maintain airway patency, it is necessary to extend the neck of the patient. The configuration and features of medical support pillow 10 facilitate extension of the patient's neck and mask ventilation of the patient in the performance of CPR.

Medical support pillow 10 of the present invention can be fabricated from a variety of materials. In one embodiment, base member 12, pad member 14 and hemispherical member 16 are fabricated from plastic. In another embodiment, base member 12, pad member 14 and hemispherical member 16 are fabricated from foam rubber. However, it is to be understood that other materials may be used as well. Furthermore, although pillow 10 and the components thereof have been described as having particular dimensions, it is to be understood that pillow 10 and the components thereof can be configured to have other dimensions suitable for any sized person, e.g. infant, child, teen, or adult.

Figure 12:
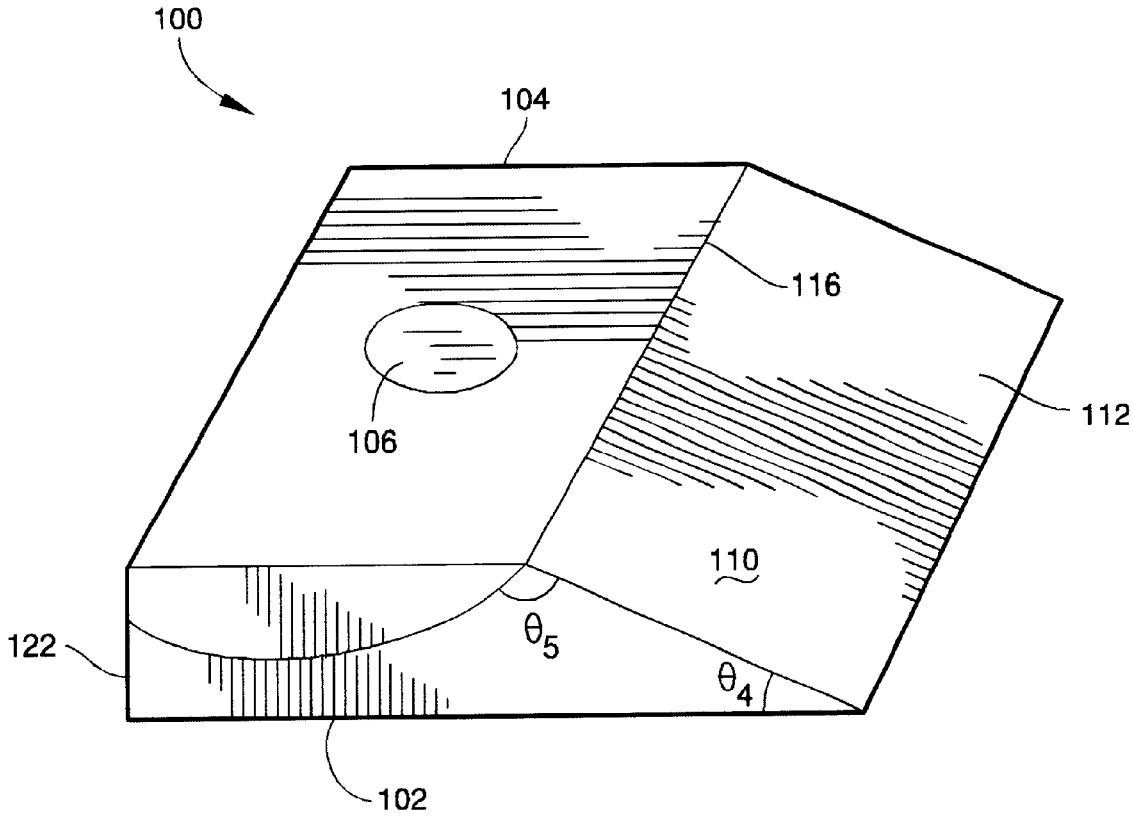
FIG. 12 is a perspective view of an alternate embodiment of the medical support pillow of the present invention.

Referring to FIG. 12, there is shown alternate medical support pillow 100 of the present invention. Medical support pillow 100 general comprises base member 102, pad member 104 and hemispherical member 106. Pad member 104 is removably positioned on base member 102. Hemispherical member 106 is removably attached to pad member 104. In order to facilitate understanding of the present invention, base member 102, pad member 104 and hemispherical member 106 are described separately in the ensuing description.

Figure 10:
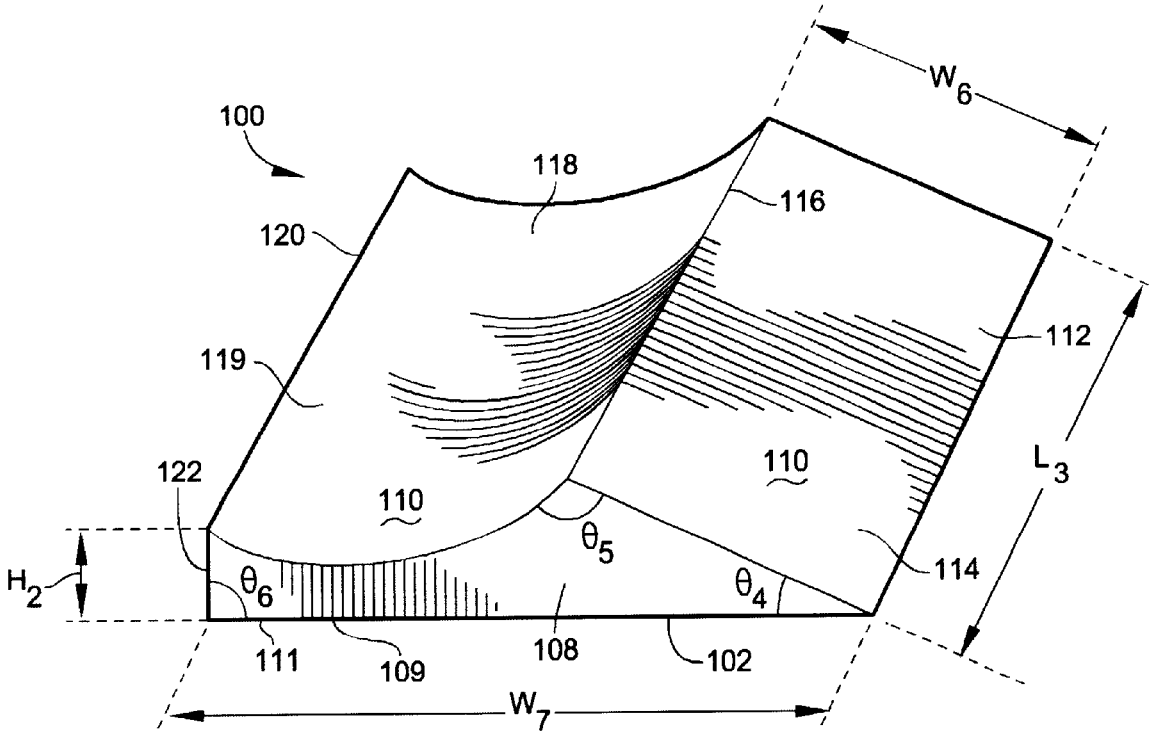
FIG. 10 is a perspective view of an alternate embodiment of the base member of FIG. 4.

Referring to FIG. 10, base member 102 comprises oppositely positioned sidewalls, one of which being sidewall 108, the other sidewall not being shown, bottom portion 109, and upper portion 110. Bottom portion 109 has bottom surface 111. Upper portion 110 comprises inclined surface 112 that extends from lower end 114 to upper end 116. Upper portion 110 further includes a generally concave-shaped recess 118 that has a surface 119 which extends between end 116 of inclined surface 112 and end 120. Base member 102 further includes an end portion 122. In a preferred embodiment, end portion 122 is generally vertical oriented. Inclined surface 112 and recess 118 have the same purpose as inclined surface 22 and recess 28, respectively, which were described previously herein (see FIG. 4).

Referring to FIG. 10, in one embodiment, inclined surface 112 has a width W6 is substantially the same as distance W1 of inclined surface 22 which was previously described herein. In a preferred embodiment, the degree of inclination θ4 of inclined surface 112 is between about 22° and 40°. In one embodiment, the degree of inclination θ4 of inclined surface 112 is about 23°. In a preferred embodiment, angle θ5 is between about 90° and 110°. In one embodiment, angle θ5 is about 100°. In a preferred embodiment, the degree of angulation θ6 of generally vertical end surface 122 with respect to bottom surface 111 is between about 80° and 100°. In one embodiment, the degree of inclination θ6 of second inclined surface 32 is about 40°. In a preferred embodiment, base member 102 has a length L3 which is substantially the same as length L1 which was previously described herein (see FIG. 4). In a preferred embodiment, base member 102 has a width W7 that is substantially the same as width W3 of base member 12 previously described herein (see FIG. 4).

Figure 11:
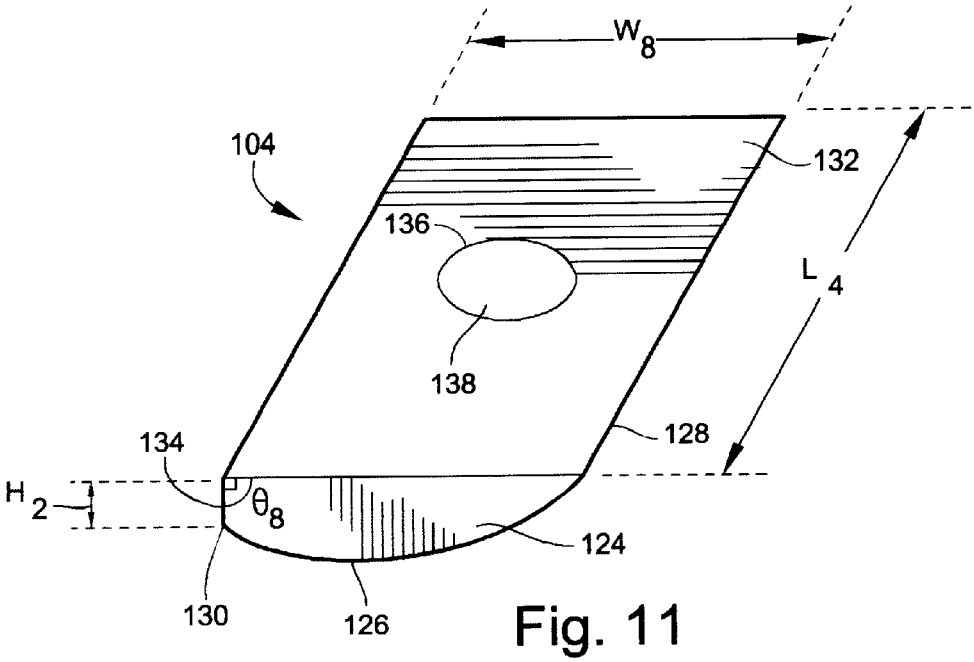
FIG. 11 is a perspective view of an alternate embodiment of the pad member shown in FIG. 5.

Referring to FIG. 11, pad member 104 comprises oppositely positioned sidewalls, one of which being sidewall 124, the other sidewall not being shown, and generally concave-shaped bottom portion 126 that conforms to generally concave-shaped recess 118. Generally concave bottom portion 126 extends between the sidewalls of pad member 104 and has first lengthwise end 128 and second lengthwise end 130. Pad member 104 further includes top portion 132 that is contiguous with the sidewalls of pad member 104 and first lengthwise end 128 of the generally concave-shaped bottom portion 126. In a preferred embodiment, top portion 132 is generally planar.

Pad member 104 further includes end portion 134 positioned between and contiguous with top portion 132 and second lengthwise end 44 of generally concave-shaped bottom portion 126. In one embodiment, end portion has a generally planar surface. End portion 134 is angulated with respect top portion 132. In a preferred embodiment, the degree of angulation θ8 of end portion 134 with respect to top portion 132 is about 90°. In one embodiment, the degree of angulation θ8 is about 140°. In a preferred embodiment, pad portion 104 has a length L4 which is substantially the same as length L3 of base member 102. In a preferred embodiment, top portion 132 has a width W8 which is between about 2 and 6 inches. In one embodiment, width W8 is about 5 inches. In a preferred embodiment, end portion 134 has a height H2 which is between 2 and 4 inches. In one embodiment, height H2 is about 3 inches.

Referring to FIG. 11, pad member 104 further includes cavity 136. Cavity 136 has opening 138 . Cavity 136 is sized to receive hemispherical member 106. Hemispherical member 106 is substantially the same in shape and construction as hemispherical member 16 which was previously discussed herein. Pad member 104, cavity 136 and hemispherical member 106 have the same purpose as pad member 14, cavity 58 and hemispherical member 16, respectively, which were discussed in the ensuing description.

Thus, medical support pillows 10 and 100 of the present invention achieve the objects set forth above and provides many advantages. Specifically, the medical support pillows 10 and 100:

a) enable quick and accurate positioning of a patient's head in a sniff position to facilitate proper endotracheal intubation;

b) enable quick and accurate positioning of a patient's head to facilitate extension of the head at the atlanto-occipital joint;

c) enable just one person to perform successful endotracheal intubation;

d) facilitates positioning of patient's head and neck in the extended position in order to maintain airway patency during spontaneous ventilation via a mask or laryngeal mask (LMA);

e) facilitates LMA insertion as well as fibroptic intubation;

f) are light weight, portable and easy to use; and g) can be manufactured at a relatively low cost.

The principals, preferred embodiments and modes of operation of the present invention have been described in the foregoing specification. The invention which is intended to be protected herein should not, however, be construed as limited to the particular forms disclosed, as these are to be regarded as illustrative rather than restrictive. Variations in changes may be made by those skilled in the art without departing from the spirit of the invention. Accordingly, the foregoing detailed description should be considered exemplary in nature and not limited to the scope and spirit of the invention as set forth in the attached claims.

What is claimed is:

1. A medical support pillow for facilitating endotracheal intubation comprising:

a base member having a pair of oppositely positioned sidewalls, a bottom portion having a bottom surface, and an upper portion, the upper portion comprising an inclined surface for receiving a portion of the upper back of a patient, a recess adjacent to the inclined surface for receiving the occipital area of the head of the patient, and an end portion adjacent to the recess and angulated with respect to the bottom surface of the base member, the recess being intermediate the inclined surface and the end portion and extending in a direction that is generally perpendicular to the sidewalls, the inclined surface being generally planar; and a pad member removably disposed within the recess, the pad member comprising a (i) pair of oppositely positioned sidewalls, (ii) a generally concave-shaped bottom portion that conforms to the generally concave-shaped recess, the generally concave-shaped portion extending between the sidewalls and having a first lengthwise end and a second lengthwise end, (iii) a top portion that is contiguous with the sidewalls and the first lengthwise end of the generally concave-shaped bottom portion, and (iv) an end portion positioned between and contiguous with the top portion and the second lengthwise end of the generally concave-shaped bottom portion, the end portion being angulated with respect to the top portion.

2. The medical support pillow according to claim 1 wherein the inclined surface has a first width and the end portion has a second width, the first width being substantially greater than the second width.

3. The medical support pillow according to claim 2 wherein the inclined surface extends from a lower end portion to an upper end portion, the upper end portion being relatively higher than the lower end portion.

4. The medical support pillow according to claim 1 wherein the top portion is generally planar and when the pad member is positioned within the recess, the generally planar top portion is generally horizontal.

5. The medical support pillow according to claim 4 wherein the end portion of said pad member is generally perpendicular to the generally planar top portion.

6. The medical support pillow according to claim 1 wherein the pad member further includes a cavity having an opening accessible through the top portion.

7. The medical support pillow according to claim 6 wherein the end portion has a generally planar surface.

8. The medical support pillow according to claim 6 further comprising a hemispherical member removably disposed within the cavity.

9. The medical support pillow according to claim 8 wherein the hemispherical member comprises a body portion having a generally planar top portion, the body portion being sized for disposal within the cavity of the pad member, the generally planar top portion being generally coplanar with the top portion of the pad member when the hemispherical member is disposed within the cavity.

10. The medical support pillow according to claim 8 wherein the base member, pad member and hemispherical member are fabricated from plastic.

11. The medical support pillow according to claim 8 wherein the base member, pad member and hemispherical member are fabricated from foam rubber.

12. A pad member for a medical support pillow, the pad member comprising (i) a pair of oppositely positioned sidewalls, (ii) a generally concave-shaped bottom portion that conforms to a generally concave-shaped recess formed in the medical support pillow, the generally concave bottom portion extending between the sidewalls and having a first lengthwise end and a second lengthwise end, (iii) a generally planar portion that is contiguous with the sidewalls and the first lengthwise end of the generally concave-shaped bottom portion, and (iv) an end portion positioned between and contiguous with the generally planar portion and the second lengthwise end of the generally concave-shaped bottom portion, the end portion being angulated with respect to the generally planar portion, the pad member further including a cavity having an opening accessible through the generally planar portion.

* * * * *